United States Patent [19]

Ishikawa et al.

[11] Patent Number: 4,872,662

[45] Date of Patent: Oct. 10, 1989

[54] SORTING APPARATUS HAVING SORTER CONNECTABLE TO ANOTHER SORTER

[75] Inventors: Takuma Ishikawa; Tadashi Maruyama; Akiyoshi Johdai; Kuniaki Ishiguro; Toshio Matsui, all of Toyokawa, Japan

[73] Assignee: Minolta Camera Kabushiki Kaisha, Osaka, Japan

[21] Appl. No.: 883,157

[22] Filed: Jul. 8, 1986

[30] Foreign Application Priority Data

Jul. 9, 1985 [JP] Japan ..... 60-104969[U]
Jun. 9, 1986 [JP] Japan ..... 61-134519

[51] Int. Cl.[4] ..... B65H 39/11; B65H 39/115

[52] U.S. Cl. ..... 271/290; 271/303

[58] Field of Search ..... 271/290, 289, 288, 298, 271/287, 303, 200, 292, 302; 270/58

[56] References Cited

U.S. PATENT DOCUMENTS

| | | | |
|---|---|---|---|
| 3,484,101 | 12/1969 | Cassano | 270/58 X |
| 3,709,480 | 1/1973 | Schulze et al. | 270/58 X |
| 3,750,880 | 8/1973 | Petrovsky et al. | 270/58 X |
| 3,848,867 | 11/1974 | Johnson | 271/173 |
| 3,853,314 | 12/1974 | Anderson | 270/58 X |
| 3,871,643 | 3/1975 | Kukucka et al. | 271/290 |
| 4,297,025 | 10/1981 | Bach et al. | 271/289 X |
| 4,318,542 | 3/1982 | Altmann et al. | 271/290 |
| 4,410,172 | 10/1983 | Holliday | 271/288 |
| 4,676,499 | 6/1987 | Kimizuka et al. | 271/289 X |
| 4,711,444 | 12/1987 | Geurts | 271/290 |

FOREIGN PATENT DOCUMENTS

| | | | |
|---|---|---|---|
| 0155152 | 12/1981 | Japan | 271/290 |
| 59-97963 | 6/1984 | Japan . | |
| 59-158763 | 9/1984 | Japan . | |

*Primary Examiner*—Kevin P. Shaver
*Assistant Examiner*—Edward S. Ammeen
*Attorney, Agent, or Firm*—Burns, Doane, Swecker & Mathis

[57] ABSTRACT

A sorting apparatus having a first sorter connectable to a second sorter. The first sorter has a plurality of sorting bins and non-sort discharge outlet. A non-sort tray or a bridge is selectively connected to the discharge outlet. The bridge has a first sheet path for transporting the discharged sheet to the second sorter and a second sheet path for transporting the discharged sheet to another non-sort tray provided to the bridge.

4 Claims, 7 Drawing Sheets

A
B
C
L

SORTING APPARATUS HAVING SORTER CONNECTABLE TO ANOTHER SORTER

BACKGROUND OF THE INVENTION

1. Field of the Invention

The present invention relates to a sorter having the sorting function of distributing sheets into a plurality of bins one after another upon receiving the sheets from a copying machine or the like and also having the nonsorting function of delivering such sheets onto a tray.

2 Description of the Prior Art

Various types of sorters have heretofore been proposed for sorting sheets delivered from copying machines as disclosed in U.S. Pat. Nos. 3,944,217, 4,466,608, etc. Such sorters have a plurality of sheet accommodating bins and are adapted to sort sheets within the range of the number of bins.

However, when it is desired to sort sheets beyond the range of the number of bins, the sorting operation within the range of bin number needs to be conducted repeatedly. Further since it is generally not frequently required to sort a large quantity of sheets, it is not economical to install a large sorter having an increased number of sheet accommodating bins for the infrequent use.

To overcome the above problem, Unexamined Japanese Patent Publication Nos. SHO 59-158763, SHO 59-97963, etc. propose sorting apparatus to which a plurality of sorters can be connected in succession so as to increase the sorting range.

Nevertheless, the sorter requires the path to be specifically used for transporting sheets to the next sorter, so that the sorter unit is complex in construction and costly.

SUMMARY OF THE INVENTION

The main object of the present invention is to provide a sorting apparatus which has a simple construction and to which a plurality of sorters are connectable to increase the number of copies of documents to be prepared by sorting.

Another object of the present invention is to provide a sorter of simple construction which is connectable to another sorter.

To fulfill these objects, the apparatus of the present invention has incorporated therein a sorter comprising first accommodating means for accommodating sheets of paper without sorting, second accommodating means for accommodating sheets of paper upon sorting, means for accepting sheets, a first path of transport of paper for guiding the accepted sheets to the first accommodating means, a second path of transport of paper for guiding the accepted sheets to the second accommodating means, and means for selecting one of the first path and the second path.

The sorter is usable of course singly as it is or as connected to another like sorter. In the latter case, the sorters are interconnected by connecting means for guiding the sheets discharged from the first path to the sheet accepting means of the next sorter.

BRIEF DESCRIPTION OF THE DRAWINGS

These objects and features of the present invention will become apparent from the following description taken in conjunction with the preferred embodiments thereof with reference to the accompanying drawings, in which:

FIG. 1 is a diagram showing a first sorter and a second sorter connected thereto by a bridge to illustrate the interior construction of the assembly;

FIG. 2 is a diagram showing the interior construction of the first sorter as it is used singly;

FIG. 3 is a fragmentary diagram showing the same;

FIG. 4 is a front view partly broken away and showing a transport roller support assembly;

FIG. 5 is a plan view partly broken away and showing a tension roller support assembly;

FIG. 6 is a front view of FIG. 5;

FIG. 7 is a diagram showing the first sorter and the second sorter connected by a bridge so as to illustrate the interior construction of the assembly;

FIG. 8 is a diagram showing the interior construction of a first sorter as it is used singly; and FIG. 9 is a diagram showing the first sorter and a second sorter connected thereto by a bridge to illustrate the interior construction of the assembly.

DESCRIPTION OF THE PREFERRED EMBODIMENTS

First embodiment (see FIGS. 1 to 7)

Figure 1:
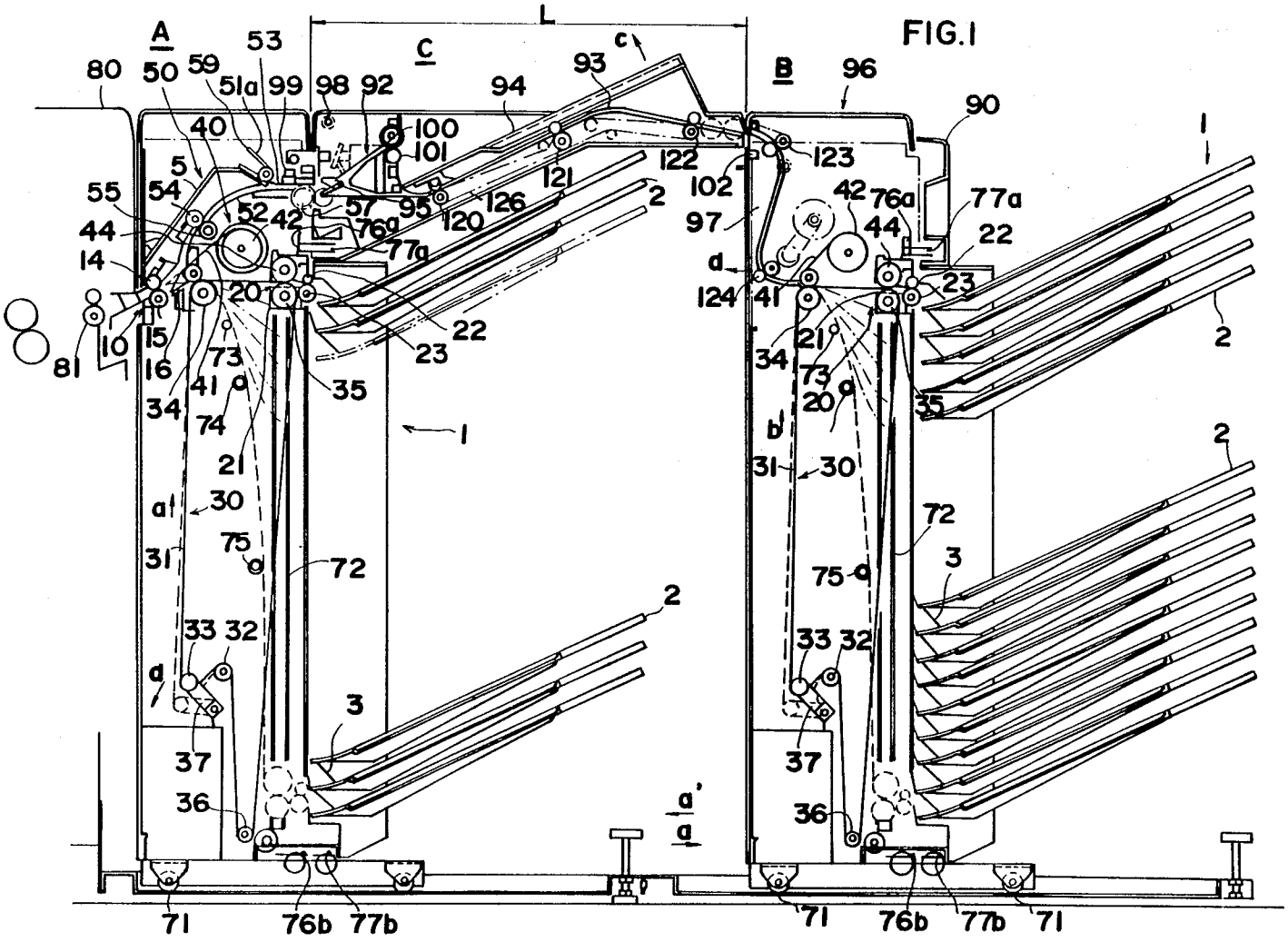
FIGS. 1 to 7 show a first embodiment.

FIG. 1 shows a sorting apparatus as a first embodiment of the present invention. The apparatus comprises a first sorter module A and a second sorter module B connected thereto by a bridge module C. The construction and operation of the first sorter A will be described first with reference to FIG. 2.

The first sorter A generally comprises a nonsorting tray 49 for accommodating sheets without sorting, a bin assembly 1 including a plurality of bins 2 arranged one above another in a row and constituting a first accommodating means for accommodating sheets as sorted and having a charge erasing brush 3 at the inlet of each bin, delivery means 20 intermittently movable downward along the inlets of the bins 2 for delivering sheets into the bins 2 one after another after receiving the sheets from a pair of discharge rollers 81 of a copying machine main body 80, transport belt means 30 including an endless transport belt 31, and tape means 40 including a retractable tape 41. The bin assembly 1 is pivotally movable about an unillustrated pin for the operator to remedy a jam occurring inside the sorter.

The sorter A is made movable in the directions of arrows a and a' by rollers 71, 71 on its bottom and is held connected to the copying machine main body 80 by unillustrated lock means, with their opposed paths of transport in alignment with each other. When released from the lock means, the sorter A itself is movable in the direction of arrow a away from the main body 80. Paper jams occurring between the sorter A and the main body 80 are treated in this state. When the second sorter B is connected to the first sorter A by the bridge C as will be described later, the bridge C and the second sorter B are movable with the first sorter A in the directions of arrows a and a' since these units are connected together by screws.

Figure 3:
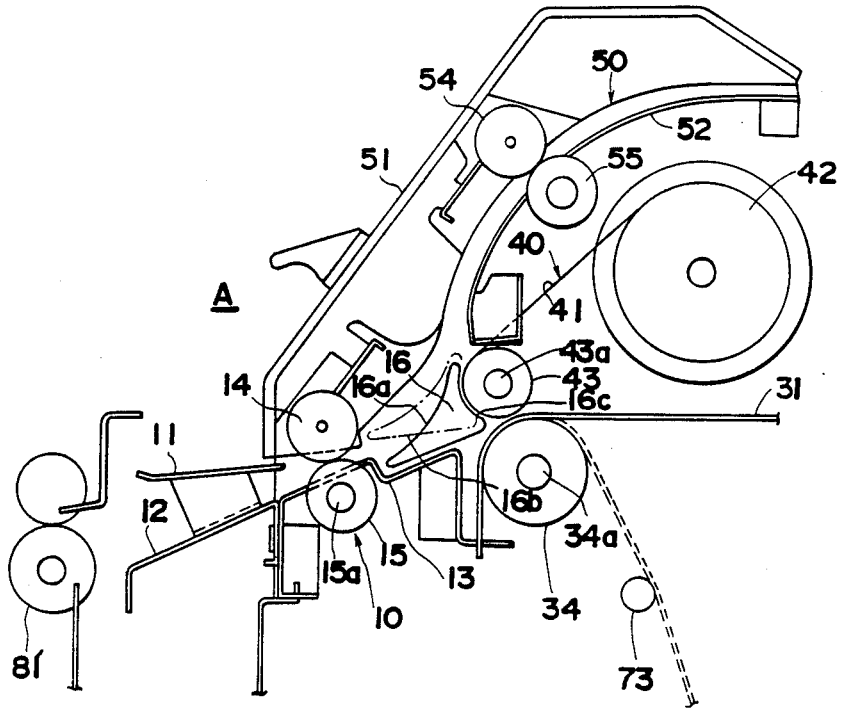

As described in detail in FIG. 3, accepting means 10 comprises guide plates 11, 12, 13, transport rollers 14, 15 and a change pawl 16 which defines a first directing means. When the sorter A only is used singly, the change pawl 16 changes sorting mode to nonsorting mode and vice versa to direct the sheets in the direction concerned. When the second sorter B is connected to the sorter A by the bridge C as shown in FIG. 1, the change pawl 16 changes first sorter sorting mode (for preparing up to 20 copies of documents by sorting) to second sorter sorting mode (for preparing at least 21 copies of documents by sorting) and nonsorting mode, and vice versa. The change pawl 16 is pivotally movable upward or downward by turning on or off an unillustrated solenoid, about the shaft 43*a* of a support roller 43 for the retractable tape 41 to be described below.

More specifically, in the nonsorting mode or in the second sorter sorting mode, the change pawl 16 is in the solid-line position, in which the sheet is guided by a curved guide surface 16*a* of the pawl 16 to the nonsorting tray 49 or to the second sorter B via the bridge C as shown in FIG. 1. Alternatively in the first sorter sorting mode, the change pawl 16 is in the broken-line position, in which the sheet is guided by a straight guide surface 16*b* of the pawl 16 to the portion of the retractable tape 41 overlapping the conveyor belt 31. In the first sorter sorting mode, the sheet urged forward by the transport rollers 14, 15 is so guided by the guide surface 16*b* that the leading end thereof will be held between the transport belt 31 and the tape 41 after coming into contact with the belt 31.

Delivery means 20 comprises delivery rollers 22, 23, a support roller 35 for the transport belt 31 and a roller 44 having the forward end of the retractable tape 41 attached thereto, these rollers being housed in a box 21. The box 21 is vertically movably supported by guide members 72 attached to the frame of the sorter A and positioned at the inlet side of the bins 2. The box 21 is intermittently movable downward by a motor Ml (see FIG. 7) and stops at the inlet of each bin 2.

The endless transport belt 31 of the belt means 30 is reeved around a drive roller 32 and rotatable support rollers 33, 34, 35, 36, partly passes through the box 21 and extends over the entire length of upward and downward movement of the delivery means 20. When the box 21 reaches a lower position, the belt 31 is supported by rollers 73, 74, 75 rotatably mounted on the sorter frame. The drive roller 32 is coupled to the motor Ml and held in contact with the belt 31 from outside to drive the belt 31 in the direction of arrow b. The support roller 33 is mounted on a lever 37 ( biased by suitable spring means in the direction of arrow d to suitably tension the belt 31.

The retractable tape 41 of the tape means 40 is wound around a roller 42 by the force of unillustrated spring means, passed around the support roller 43 and attached at its forward end to the roller 44. The retractable tape 41, like the transport belt 31, comprises a plurality of strips and laps over the belt 31 between the rollers 43 and 44. (Between these rollers, the strips of the tape 41 and those of the belt 31 are arranged alternately and coextensive.) The tape 41 is paid off from the roller 42 when the delivery means 20 descends, while it is taken up on the roller 42 when the delivery means ascends. The tape 41 is electrically conductive and is prevented from triboelectrically attracting sheets thereto.

To drive the delivery roller 23, the shaft 23*a* of the roller 23 is coupled to the shaft 35*a* of the support roller 35 by unillustrated gear means. The delivery roller 22 is driven by the rotation of the roller 23. Suppose the speed of transport of sheets by the delivery rollers 22, 23 is v1, the speed of transport by the belt 31 is v2, and the speed of transport by the transport rollers 14, 15 is v3. These speeds have the following relationship.

$$v1 > v2 > v3$$

Transport means 50 is adapted to transport sheets from the accepting means 10 to the nonsorting tray 49, or to the second sorter B through the bridge C as shown in FIG. 1. The transport means 50 comprises guide plates 51, 52, 53, transport rollers 14, 15, 54, 55, delivery means including delivery rollers 56, 57 and a charge erasing brush 58. The guide plate 51 is pivotally movable upward or downward as supported by a pin 51*a*, is biased downward at all times by a torsion spring 59 and is held in position. The rollers 14, 54 are mounted on the guide plate 51, which is upwardly openable in the event of a paper jam.

With reference to FIG. 1, the bridge C is connected to the first sorter A, with a cover 90 removed from the sorter A. The bridge C comprises transport means 92 for transporting sheets to a nonsorting tray 94 which constitutes a third accommodating means, transport means 93 for transporting sheets to the second sorter B, a change pawl 95 defining a second directing means for changing the direction of transport of sheets to one direction in the nonsorting mode or to another direction in the second sorter sorting mode, and the above-mentioned nonsorting tray 94 serving also as a cover for the bridge C itself. The second sorter B has transport means 97 for guiding sheets from the bridge C to a position where a retractable tape 41 laps over a transport belt 31. The second sorter B has the same construction as the first sorter A with the exception of the means 97 and further except that the sorter B is not provided with the nonsorting tray 49 or the transport means 50. Accordingly, like parts are designated by like reference numerals throughout the several drawings concerned.

To treat the possible paper jams, the nonsorting transport means 92 and the transport means 93 for the second sorter B are openable in the direction of arrow c as supported by a pin 98. Further the bridge C has such a length L that the bin assembly is openable free of interference.

To treat paper jams occurring in the second sorter B, the transport means 97 is openable in the direction of arrow d as supported on a pin 102.

Figure 7:
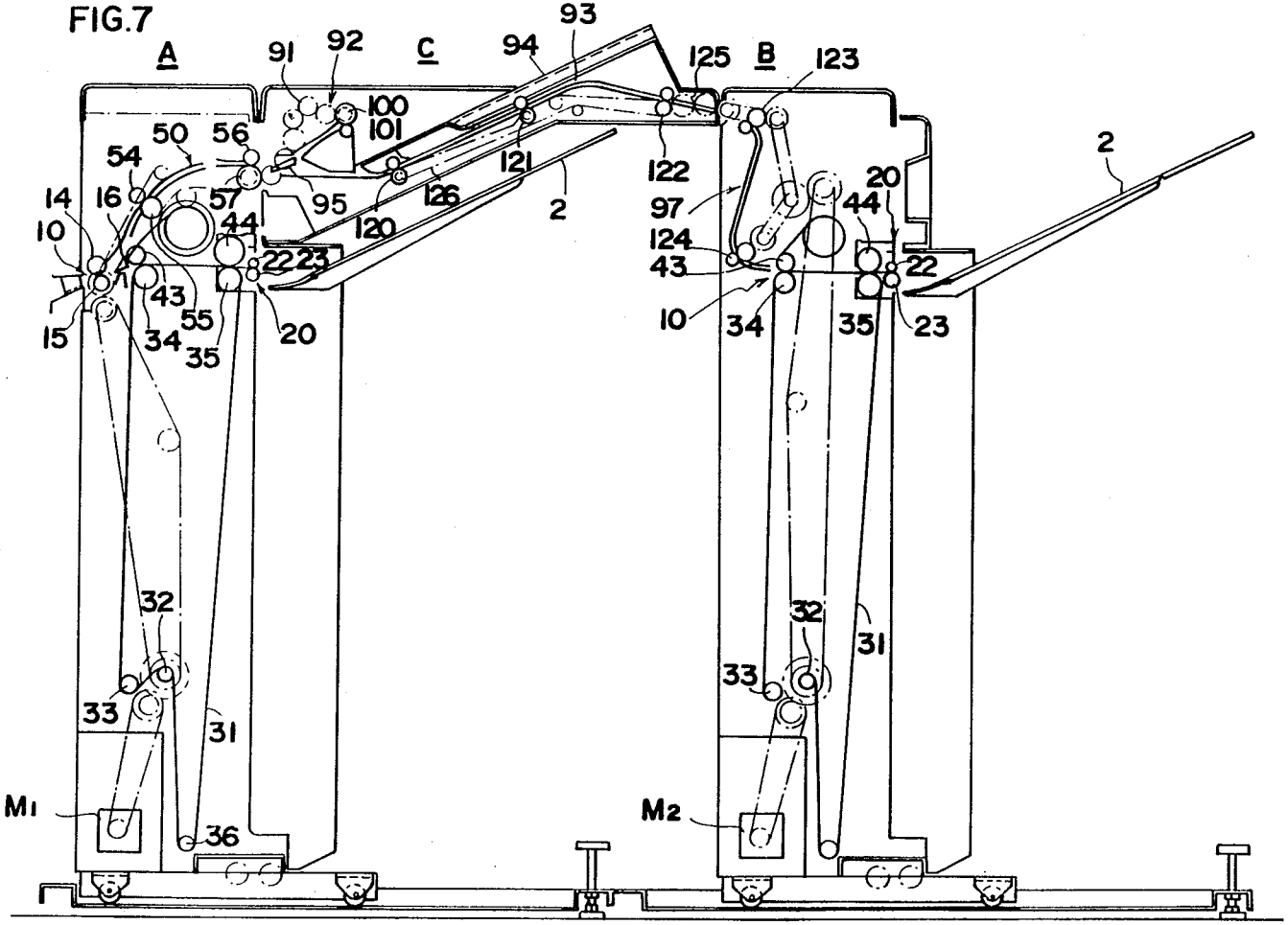

The drive system will now be described with reference to FIG. 7.

The nonsorting transport means 92 of the bridge C includes delivery rollers 100, 101. The delivery roller 100 is drivingly rotated by the delivery roller 57 of the first sorter A through a gear train 91. The transport means 93 for the second sorter B includes transport rollers 120, 121, 122 which are drivingly rotated by the shaft of a transport roller 123 in the second sorter B via a gear train 125 and a timing belt 126. The first and second sorters A and B incorporate motors M1 and M2, respectively, as drive sources.

The operation of the sorters will be described.

Figure 2:
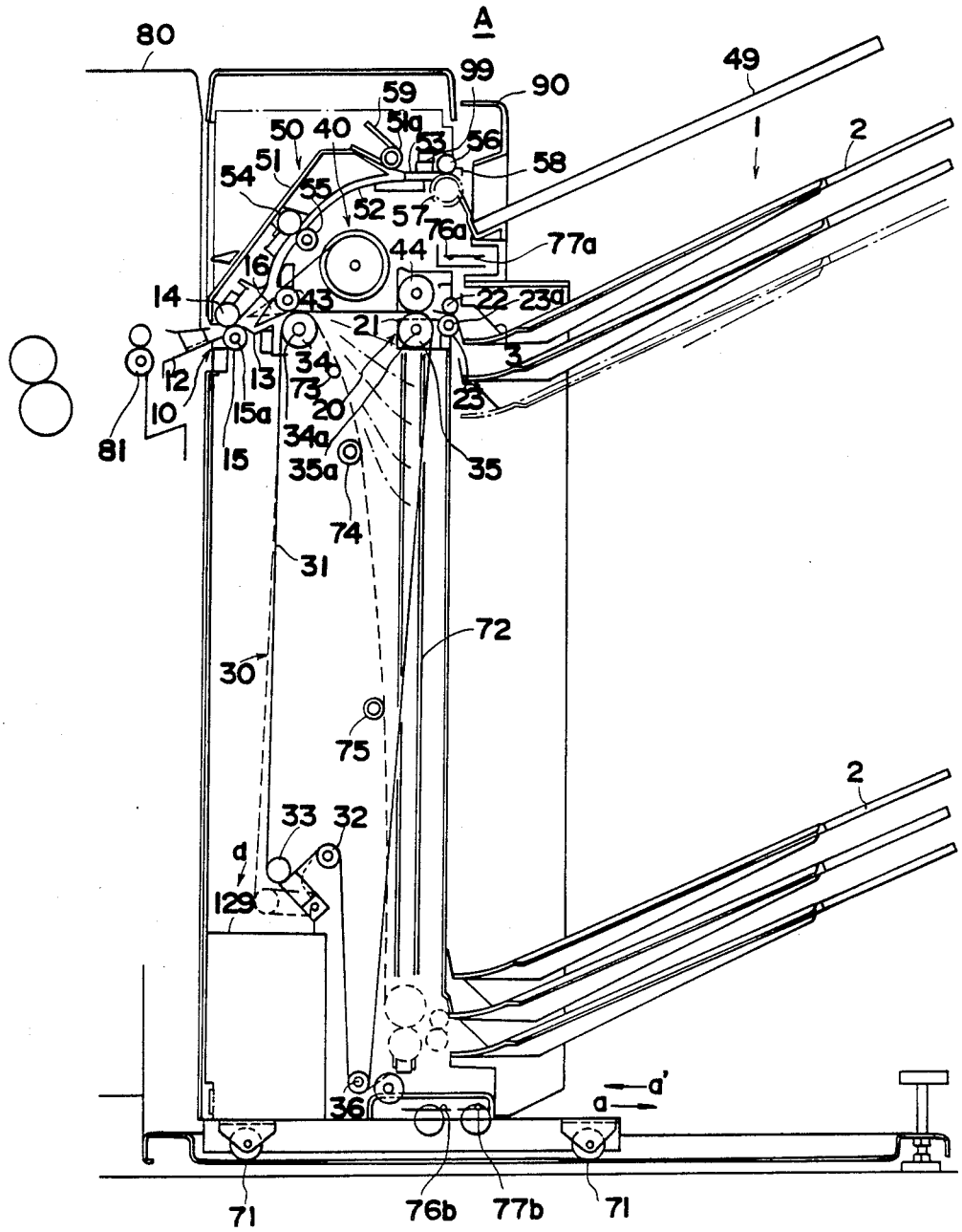

First, the first sorter A shown in FIG. 2 as singly used will be described.

In the nonsorting mode, the change pawl 16 is in the solid-line position shown in FIG. 3. A sheet discharged from the copying machine main body 80 is sent into the transport means 50 by being forced forward by the transport rollers 14, 15 and being guided by the guide surface 16*a* of the pawl 16 and is delivered onto the nonsorting tray 49 by the delivery rollers 56, 57 after passing between the transport rollers 54, 55.

On the other hand, when the sorting mode is selected, the unillustrated solenoid is energized, pivotally moving the change pawl 16 to the broken-line position in FIG. 3. The delivery means 20 is already in its home position as opposed to the inlet of the uppermost bin 2. A sheet discharged from the copying machine main body 80 is guided by the guide surface 16*b* of the pawl 16 while being forced forward by the transport rollers 14, 15 and is directed toward the position where the tape 41 laps over the belt 31. The leading end of the sheet first comes into contact with the belt 31 and is then held between the belt 31 and the tape 41. The sheet is transported to the delivery means 20 by the travel of the belt 31 in the direction of arrow b and placed into the uppermost bin 2 by the delivery rollers 22, 23. When the sheet has been sent into one bin 2, the delivery means 20 descends by one step to a position, opposed to the inlet of the next bin 2, where another sheet is similarly placed into the bin 2. When the desired number of sheets have been sorted out or a sheet has been delivered to the lowermost bin 2, the delivery means 20 returns to the home position.

When to be delivered to each bin 2 or to the nonsorting tray 49, the sheet is acted on by the charge erasing brush 3 or 58, whereby the sheet is prevented from being delivered in a raised position and is also deprived of charges. The delivery of the sheet is detected by a reflective photosensor 99 in the nonsorting mode or by a transmission-type photosensor dividedly provided at upper and lower portions of the sorter A as indicated at 76*a*, 76*b*, the latter sensor being used in the sorting mode. The presence or absence of the sheet on the bin 2 is detected by another transmission-type photosensor 77*a*, 77*b*.

A description will now be made of the operation of the assembly of the first sorter A and the second sorter B connected thereto by the bridge C as seen in FIG. 1.

In the nonsorting mode, the change pawl 16 is in the solid-line position in FIG. 3, and the change pawl 95 in the solid-line position in FIG. 1. A sheet delivered from the copying machine main body 80 is sent into the transport means 50 by being forced forward by the transport rollers 14, 15 as already described, is passed between the transport rollers 54, 55 and is sent into the bridge C by the delivery rollers 56, 57. The sheet is further guided along the upper surface of the pawl 95, sent to the nonsorting transport means 92 and delivered onto the nonsorting tray 94 by the delivery rollers 100, 101.

When the sorting mode for preparing up to 20 copies is selected, the same operation as when the first sorter A only is used is conducted. In the nonsorting mode and also in the sorting mode for preparing up to 20 copies, the motor M1 of the first sorter A only is driven, with the motor M2 of the second sorter B held out of operation.

When the sorting mode for at least 21 copies is selected, the same operation as when the first sorter A only is used is conducted for preparing up to 20 copies. Upon lapse of a predetermined period of time after an unillustrated sheet discharge sensor within the copying machine main body 80 has detected the sheet for the 20th copy, the change pawl 16 is shifted to the solid-line position and the change pawl 95 to the broken-line position in FIG. 1, and the motor M2 of the second sorter B is energized. The sheets for the 21st and subsequent copies are passed through the transport means 50, guided by the lower surface of the pawl 95, sent into the transport means 93 for the second sorter B, passed over the rollers 123, 124 of the transport means 97 of the second sorter B and then forwarded to the portion of the retractable tape 41 lapping over the transport belt 31. The same sorting operation as already described for the first sorter A thereafter follows within the second sorter B. Thus, the sheets are sorted in bin assembly 1 which constitutes a second accommodating mean for accommodating the sorted sheets.

In the nonsorting mode described above, the sheet is transported not by the belt 31 and the retractable tape 41 but by the specific transport means 50. This gives a prolonged life to the belt 31 and the tape 41. Further since most of sheets of sizes other than the regular sizes are transported in the nonsorting mode, the frequency of paper jams greatly decreases. Even if the transport means 50 should be jammed with paper, the guide plate 51 can be opened upward to readily remedy the jam.

In the sorting mode, the sheet is given a force of transport by the transport rollers 14, 15 immediately before being held between the belt 31 and the tape 41, so that the sheet can be caught by these members reliably. Moreover, the leading end of the sheet before being held by the members is guided by the guide surface 16*b* of the change pawl 16 and comes into contact with the belt 31 in travel while advancing in the same direction as the travel of the belt, instead of coming into contact with the tape 41 which is at rest. This permits the sheet to be caught by the belt and tape smoothly. The change pawl 16 is pivotally movable as supported by the shaft 43*a* of the support roller 43 to change the direction of transport of sheets. This assures a simplified arrangement and renders the guide surfaces 16*a*, 16*b* operable with good stability. Additionally, the change pawl 16 has a circular arc rear portion 16*c* which serves as a guide for the retractable tape 41 when the tape is reeved around the support roller 43. The tape 41 can therefore be installed easily.

The drive roller 32 is in contact with the transport belt 31 from outside, so that the belt is replaceable without the necessity of removing the drive roller 32 and accordingly without removing the drive system. This obviates the need to readjust the drive system, rendering the belt replaceable with ease.

Figure 4:
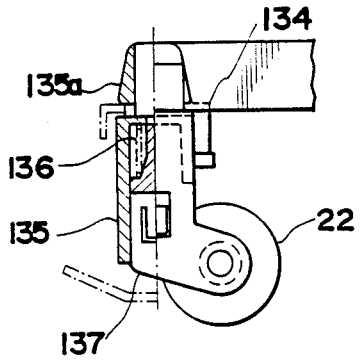

As seen in FIG. 4, the delivery roller 22 is attached to a holder 135 and is biased downward by a coiled compression spring 136. The holder 135 can be attached to a guide plate 134 by forcing the head 135*a* of the holder into an opening in the guide plate from below by a snap-in action. Although the spring means conventionally used is a plate spring fastened to the guide plate 134 by a screw, the roller assembly is easy to install.

Figure 5:
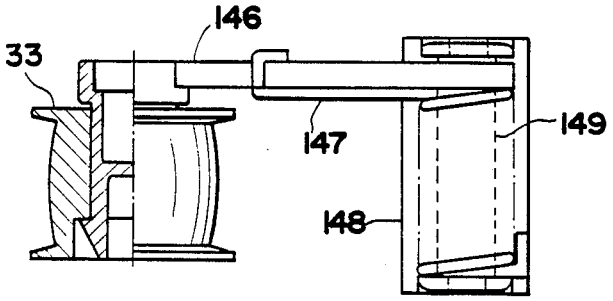
Figure 6:
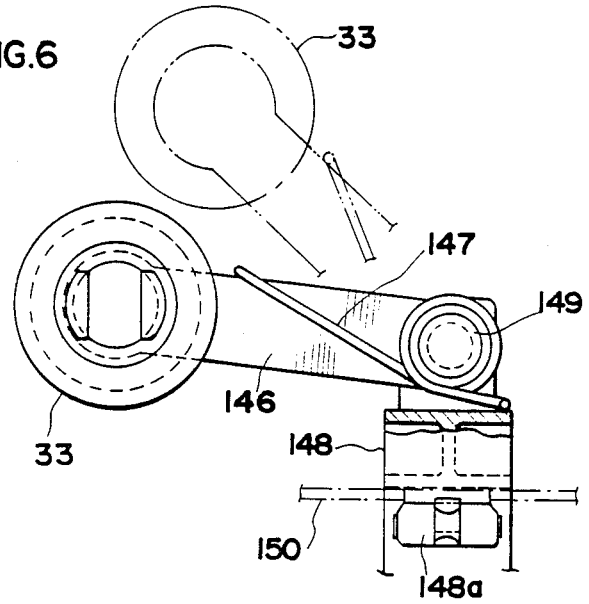

With reference to FIGS. 5 and 6, the support roller 33 for tensioning the transport belt 31 is mounted on the free end of an arm 146 attached to a rod 149 on a holder 148 and is biased downward along with the arm 146 by a torsion spring 147 wound around the rod 149. The holder 148 can be mounted on an electric unit cover 150 by forcing the head 148*a* thereof into an opening in the cover sideways by a snap-in action. The arrangement is easy to install although the torsion spring, rod, etc. are conventionally assembled for installation.

The means 92 for transporting sheets to the nonsorting tray 94 of the bridge C is coupled to the motor M1 of the first sorter A, and the means 93 for transporting sheets to the second sorter B is coupled to the motor M2 of the second sorter B, so that there is no need to mount a motor on the bridge C, preventing a cost increase and obviating troubles due to a difference in sheet transport speed. In the nonsorting mode, the first sorter A only is driven, while the sheet transport means 93 for the second sorter B is driven only when the second sorter B is used. This achieves an improved efficiency and diminishes noises to the greatest possible extent. Should the second sorter B malfunction, the first sorter A is operable in the nonsorting mode, hence convenience.

Figure 8:
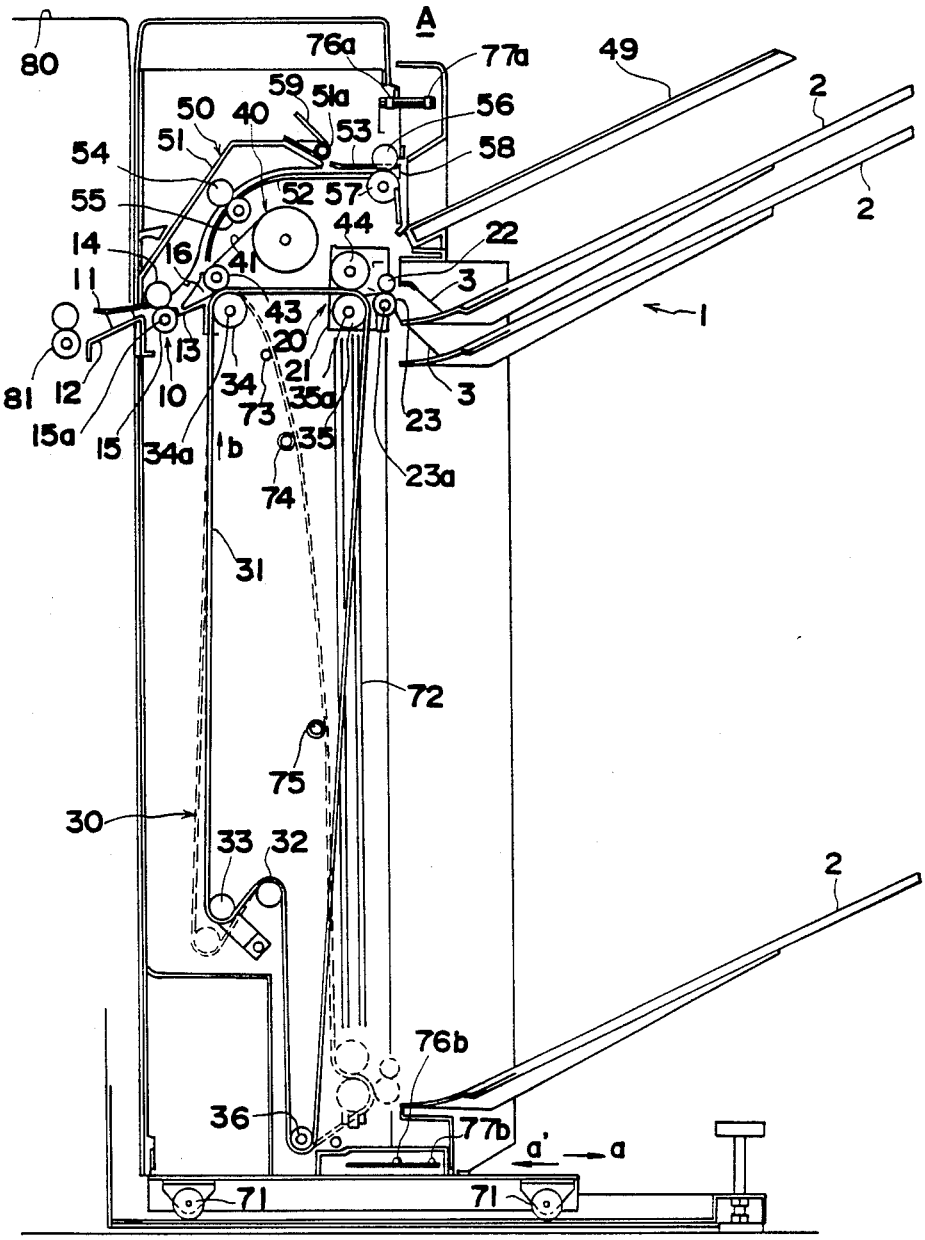
FIGS. 8 and 9 show a second embodiment.
Figure 9:
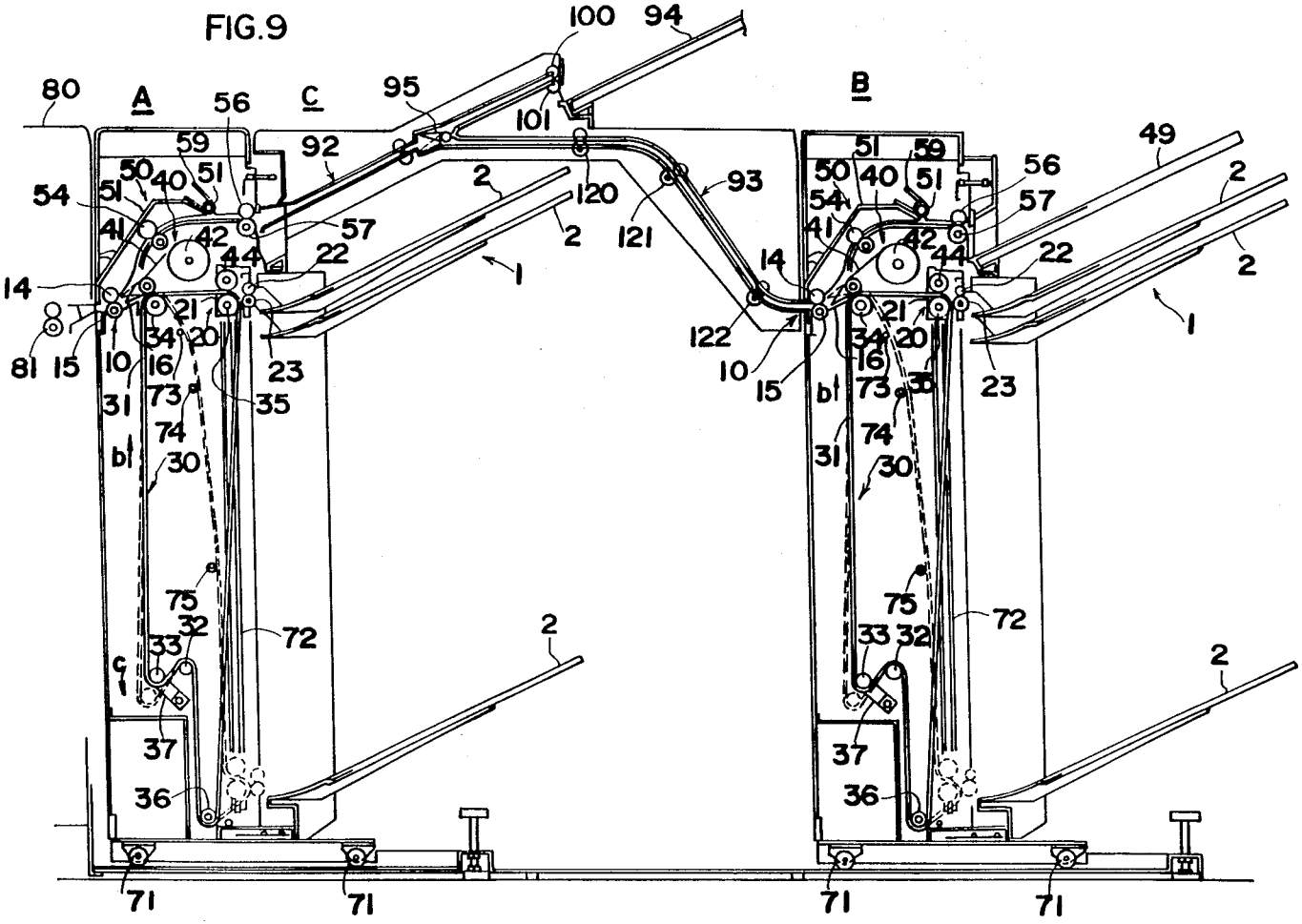

Second embodiment (see FIGS. 8 and 9)

The second embodiment has basically the same construction as the first embodiment except that the second sorter B has the same structure as the first sorter A. Accordingly, the bridge C is adapted to deliver sheets to the transport rollers 14, 15 of the second sorter B, and the second sorter B is also adapted to deliver sheets onto its nonsorting tray 49.

The rollers 100, 101 of the bridge C are drivingly rotatable by the motor M1 of the first sorter A, while the rollers 120, 121, 122 are drivingly rotatable by the motor M2 of the second sorter B.

Thus, the first sorter A, the second sorter B and the bridge C operate in the same manner as in the first embodiment, exhibiting the same advantages as in the first embodiment.

Further according to the second embodiment, a third sorter can be connected to the second sorter B by another bridge C provided in place of the nonsorting tray 49 of the sorter B. In this case, the drive motor of the third sorter is driven when the sheet passes through the transport means 50 of the second sorter B. The third sorter is further connectable to a fourth sorter and further to a fifth sorter. As in the above case, the drive motor of the additional sorter is energized when the sheet passes through the transport means 50 of the immediately preceding sorter. Other embodiments The sorting apparatus of the present invention is not limited to the foregoing embodiments but can be modified variously within the scope of the invention. The distribution system in particular is not limited to the movable gate type of the above embodiments but can be of the movable bin type or of the change-over pawl type.

What is claimed is:

1. A sorting apparatus comprising:

a first sorter module having a first accomodating means for accommodating and sorting sheets of paper, a delivery means including a pair of delivery rollers for discharging sheets of paper without sorting, an inlet means for accepting sheets, a first path of transport of paper for guiding the accepted sheets from said inlet means to said first accommodating means, a second path of transport of paper for guiding the accepted sheets form said inlet means to said delivery means, wherein substantially all of said second path is distinct from said first path, and a first directing means at the inlet means for directing the accepted sheet to either said first path or said second path;

a second sorter module which is separated from said first sorter module and having a second accommodating means for accommodating and sorting sheets of paper; and a bridge module detachably connected between said first sorter module and second sorter module for accommodating the discharged sheet without sorting and transporting the discharged sheet to said second sorter module;

said bridge module having a third accomodating means for accommodating sheets of paper without sorting, a third path of transport of paper for guiding the sheet discharged from said delivery means to said third accommodating means, a fourth path of transport of paper for guiding the sheet discharged from said delivery means to said second accommodating means, and a second directing means for directing the discharged sheet to either said third path or said fourth path.

2. A sorting apparatus comprising:

a first sorter module having a first accommodating means for accommodating and sorting sheets of paper, a delivery means including a pair of delivery rollers for discharging sheets of paper without sorting, an accepting means for accepting sheets, a first path of transport of paper for guiding the accepted sheets from said accepting means to said first accommodating means, a second path of transport of paper for guiding the accepted sheets from said accepting means to said delivery means, a first directing means for directing the accepted sheet to either said first path or said second path, and a first driving means for driving said first sorter module;

a second sorter module having a second accommodating means for accommodating and sorting sheets of paper, and second driving means for driving said second sorter module; and a bridge module detachably connected between said first sorter module and second sorter module for accommodating the discharged sheet without sorting and transporting the discharged sheet to said second sorter module, said bridge module having a third accommodating means for accommodating sheets of paper without sorting, a first transporting means for transporting the sheet discharged from said delivery means to said third accomodating means, and a second transporting means for transporting the sheet discharged from said delivery means to said second sorter module, wherein said first transporting means is driven by said first driving means and said second transporting means is driven by said second driving means.

3. A sorting apparatus comprising:

a first sorter module having a first accommodating means for accommodating and sorting sheets of paper, a delivery means including a pair of delivery rollers for discharging sheets of paper without sorting, an accepting means for accepting sheets, a first path of transport of paper for guiding the accepted sheets from said accepting means to said first accommodating means, a second path of transport of paper for guiding the accepted sheets from said accepting means to said delivery means, a first directing means for directing the accepted sheet to either said first path or said second path, and a first driving means for driving said first sorter module;

a second sorter module having a second accommodating means for accommodating and sorting sheets of paper, and second driving means for driving said second sorter module; and a bridge module detachably connected between said first sorter module and second sorter module for accommodating the discharged sheet without sorting and transporting the discharged sheet to said second sorter module, said bridge module having a third accommodating means for accommodating sheets of paper without sorting, a first transporting means for transporting the sheet discharged from said delivery means to said third accommodating means, and a second transporting means for transporting the sheet discharged from said delivery means to said second sorter module, wherein said first transporting means is driven by said first driving means and said second transporting means is driven by said second driving means;

wherein said second driving means is stopped when said directing means directs the accepted sheet to said first accommodating means.

4. A sorting apparatus as claimed in claim 3, wherein said first accommodating means is capable of accommodating and sorting sheets of paper within a predetermined number of sheets;

said directing means directs the accepted sheets to said first accommodating means when the predetermined number of sheets are accommodated and sorted by said first sorter module; and said directing means directs the accepted sheets to said delivery means when an excessive number of sheets exceeding the predetermined number of sheets are accommodated and sorted by said second sorter module.

* * * * *